US011042108B2

(12) United States Patent
Mogi

(10) Patent No.: US 11,042,108 B2
(45) Date of Patent: Jun. 22, 2021

(54) AIR BLOWING COOLING MECHANISM, IMAGE HEATING APPARATUS AND IMAGE FORMING APPARATUS

(71) Applicant: CANON KABUSHIKI KAISHA, Tokyo (JP)

(72) Inventor: Keisuke Mogi, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/400,440

(22) Filed: May 1, 2019

(65) Prior Publication Data

US 2019/0339645 A1 Nov. 7, 2019

(30) Foreign Application Priority Data

May 2, 2018 (JP) ..... JP2018-088693

(51) Int. Cl.
*G03G 21/20* (2006.01)
*G03G 15/20* (2006.01)

(52) U.S. Cl.
CPC ..... *G03G 15/2017* (2013.01); *G03G 15/2042* (2013.01); *G03G 15/2064* (2013.01); *G03G 21/206* (2013.01); *G03G 2221/1645* (2013.01)

(58) Field of Classification Search
CPC ..... G03G 15/2042; G03G 15/2017; G03G 21/206; G03G 2221/1645; G03G 15/2039
See application file for complete search history.

(56) References Cited

U.S. PATENT DOCUMENTS 8,655,242 B2 * 2/2014 Tanaka ..... G03G 15/2028 399/323
2012/0282002 A1 * 11/2012 Murasaki ..... G03G 15/2042 399/329
2014/0112680 A1 4/2014 Ueno et al.
2014/0321873 A1 * 10/2014 Kadowaki ..... G03G 15/2042 399/69
2015/0241824 A1 8/2015 Sekiya
2018/0059590 A1 * 3/2018 Suzuki ..... G03G 21/206

FOREIGN PATENT DOCUMENTS

JP 2014-102486 A 6/2014
JP 2015-158600 A 9/2015

OTHER PUBLICATIONS

Copending, unpublished U.S. Appl. No. 16/400,408 to Keisuke Mogi, filed May 1, 2019.

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An air blowing cooling mechanism includes a duct provided with an air blowing port, a fan configured to blow air toward the air blowing port, a first louver portion provided inside the duct, a shutter member, and a second louver portion provided downstream of the shutter member with respect to an air blowing direction of the fan. With respect to the air blowing direction, the fan, the first louver portion, the shutter member, the second louver portion and the rotatable heating member are disposed in a named order.

9 Claims, 15 Drawing Sheets

(a) FULL-CLOSE STATE (b) FULL-OPEN STATE

AIR BLOWING COOLING MECHANISM, IMAGE HEATING APPARATUS AND IMAGE FORMING APPARATUS

FIELD OF THE INVENTION AND RELATED ART

The present invention relates to an air blowing cooling mechanism for use with an image heating apparatus, and relates to the image heating apparatus and an image forming apparatus. This image heating apparatus is, for example, capable of being used as a fixing device for heat-fixing a toner image formed on a recording material. The image forming apparatus includes, for example, a copying machine, a printer, a facsimile machine or a multi-function machine having a plurality of functions of these machines, using an electrophotographic type.

For example, in an electrophotographic image forming apparatus, an unfixed toner image is formed on a sheet-like recording material (sheet) or paper by an image forming means, and thereafter, is fixed as a fixed image by a fixing means.

As a type of the fixing means, various types have been proposed, but a fixing device of a heat and pressure type in which the toner image is fixed under application of heat and pressure has been used in general. This fixing device includes a rotatable heating member (fixing roller, fixing film or the like) to be heated by a heating means and a rotatable pressing member (pressing roller, pressing belt or the like) for forming a fixing nip in press-contact with the rotatable heating member. Then, both the rotatable members are rotated, and a sheet on which the unfixed toner image is carried is guided into the fixing nip and is nipped and fed through the fixing nip, so that the toner image is fixed on a surface of the sheet by the heat of the rotatable heating member and nip pressure.

In such a fixing device, a surface temperature excessively increases in a non-sheet-passing region (non-contact region with the sheet) of the rotatable heating member when small-size sheets (smaller in width than maximum-size sheets which can be passed through the fixing device and which have a maximum width) are continuously passed through the fixing device and thus fixing is carried out.

Here, the non-sheet-passing region (non-sheet-passing portion) is a region of the rotatable heating member which does not contact the small-size sheets when the small-size sheets are passed through the fixing device. This is because when the small-size sheets are continuously passed through the fixing device, in the non-sheet-passing region through which the sheets do not pass, heat is partly accumulated correspondingly to no heat extraction by the sheets. This phenomenon is called end portion temperature rise or non-sheet-passing portion temperature rise of the fixing device, and when this end portion temperature rise becomes an excessively high temperature level, it leads to an occurrence of hot offset and thermal deterioration of device constituent component parts.

As one of countermeasures against this non-sheet-passing portion temperature rise, a mechanism in which a cooling fan for cooling the non-sheet passing portion is provided has been known. Japanese Laid-Open Patent Application (JP-A) 2015-158600 discloses a constitution in which ducts for permitting blowing of air from cooling fans are provided at left and right sides of a fixing roller with respect to a longitudinal direction and in which shutters capable of opening and closing openings of the ducts are provided. In JP-A 2015-158600, each of the shutters is moved to a position depending on a width size of the sheet, and the air is blown by the cooling fan depending on a temperature detected by an element for detecting a temperature of a non-sheet-passing portion of the fixing roller. Thus, a cooling range is adjusted by moving the shutter, so that the non-sheet-passing portion temperature rise is suppressed.

Further, in JP-A 2015-158600, a constitution in which cooling air is blown from the duct provided with the fan toward the fixing roller inside a fixing device is employed.

The fixing roller used in the constitution disclosed in JP-A 2015-158600 principally has a diameter of 30 mm or more. In the case where a diameter of a member-to-be-cooled (fixing roller) is relatively large when the member-to-be-cooled is seen in an air blowing direction of the fan, the cooling air is easily blown on the member-to-be-cooled even when an air path forming member such as a louver is not provided on an air blowing path from the fan to the member-to-be-cooled.

On the other hand, in recent years, from the viewpoints of downsizing and cost reduction of the image forming apparatus, as a fixing member such as the fixing roller or a fixing film, a member having a diameter smaller than 30 mm is used in some instances.

In such a case where the fixing member having the small diameter is cooled, in a constitution in which there is no air path forming member as in JP-A 2015-158600, the fixing member was not able to be efficiently cooled in some instances.

SUMMARY OF THE INVENTION

A principal object of the present invention is to provide an air blowing cooling mechanism capable of efficiently cooling a film having a small diameter in a constitution of an air blowing cooling apparatus for cooling a rotatable heating member by a fan.

One aspect of the present invention provides an air blowing cooling mechanism for use with an image heating apparatus including a rotatable heating member for heating a toner image on a recording material in a nip. The air blowing cooling mechanism includes a duct provided with an air blowing port; a fan configured to blow air toward the air blowing port through a duct to cool a predetermined region of the rotatable heating member; a first louver portion provided inside the duct and configured to rectify the air from the fan toward the air blowing port; a shutter member configured to limit a cooling range of the rotatable heating member; and a second louver portion provided downstream of the shutter member with respect to an air blowing direction of the fan. The fan, the first louver portion, the shutter member, the second louver portion, and the rotatable heating member are disposed in a named order with respect to the air blowing direction.

Further features of the present invention will become apparent from the following description of exemplary embodiments with reference to the attached drawings.

Figure 15:
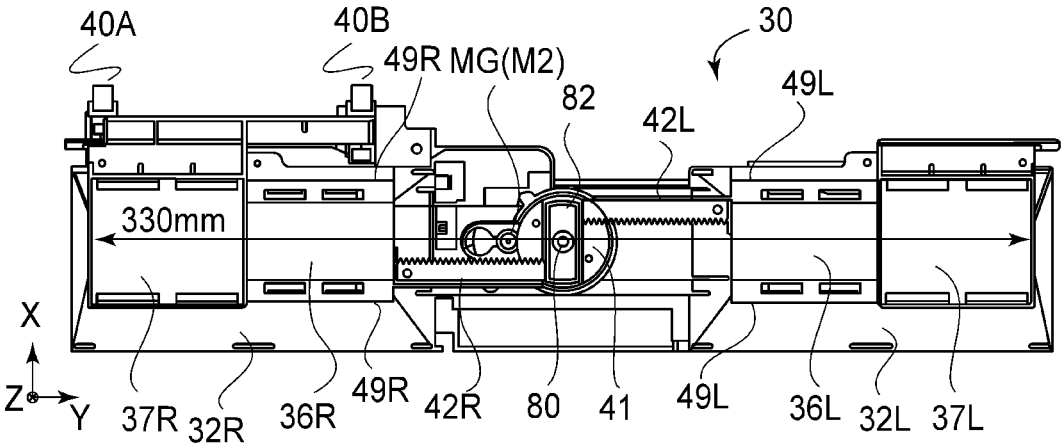
Figure 15:
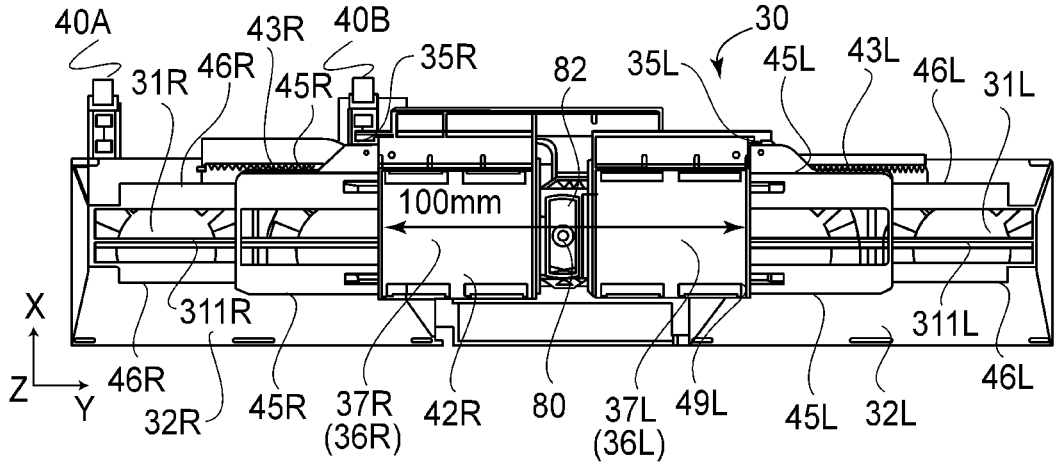

Part (a) of FIG. 15 is a schematic view of a structure of two shutter members in a full-close state on one side, and part (b) of FIG. 15 is a schematic view of a structure of two shutter member in a full-open close state on one side.

DESCRIPTION OF EMBODIMENTS

Embodiments for carrying out the present invention will be specifically described with reference to the drawings. Dimensions, materials, shapes and relative arrangements of constituent elements described in the following embodiments should be appropriately be changed depending on structures and various conditions of mechanisms (apparatuses) to which the present invention is applied, and the scope of the present invention is not intended to be limited to the following embodiments.

Embodiment 1

(Image Forming Apparatus)

Figure 1:
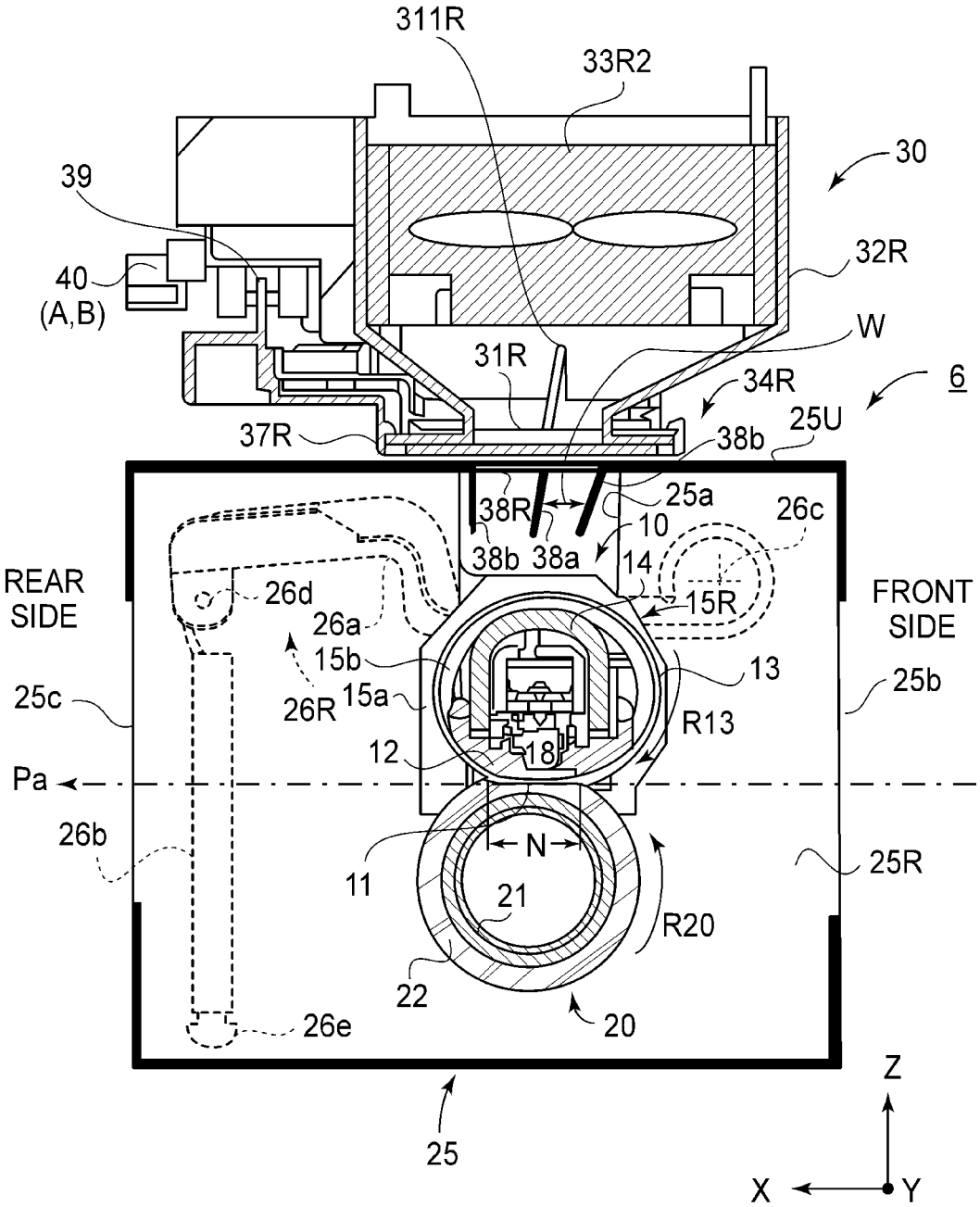
FIG. 1 is a schematic sectional view of fixing device taken along (6)-(6) line shown in FIG. 3.
Figure 2:
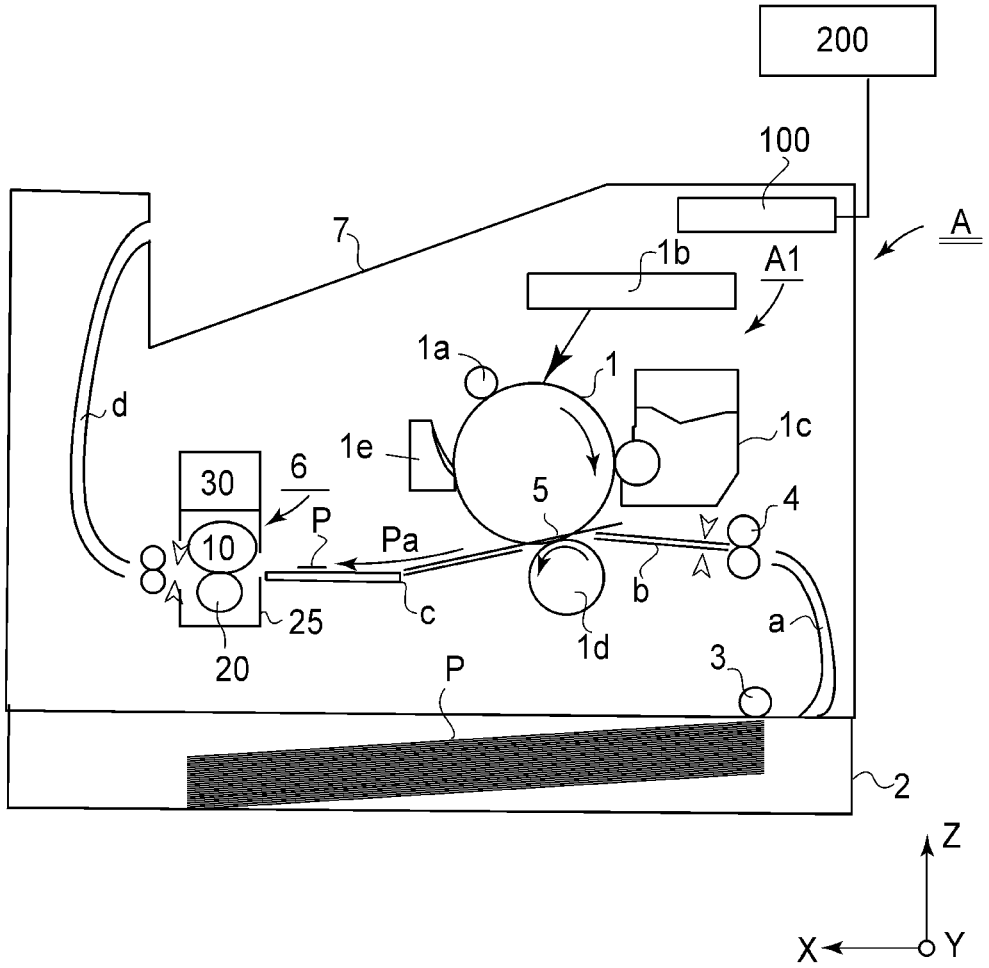
FIG. 2 is a schematic sectional view showing a general structure of an image forming apparatus in Embodiment 1.

FIG. 2 is a schematic sectional view showing a general structure of an example of an image forming apparatus A using electrophotography. In this embodiment, the image forming apparatus A is a monochromatic printer in which an image-formed product on which a toner image was formed by executing an image forming operation corresponding to a print job (image forming job) inputted from an external host device 200 such as a personal computer to a control circuit portion (CPU) 100 is printed out.

In the image forming apparatus A, an image forming portion A1 for forming the toner image on a recording material P (sheet or paper) includes a drum-type electrophotographic photosensitive member (drum) 1 as an image bearing member. The drum 1 is rotationally driven at a predetermined peripheral speed in the clockwise direction indicated by an arrow. Further, at a periphery of the drum 1 along a drum rotational direction, the image forming portion A1 includes, as process devices actable on the drum 1, a charging roller 1*a*, a laser scanner 1*b*, a developing device 1*c*, a transfer roller 1*d* and a cleaning device 1*e*. An electrophotographic process and an image forming operation of the image forming portion A1 are well known, and therefore will be omitted from description.

Incidentally, the recording material P is a sheet-shaped recording medium (media) on which the toner image is capable of being formed by the image forming apparatus. For convenience, treatment of the recording material (sheet) P will be described using sheet (paper)-related terms such as sheet passing, sheet feeding, sheet discharge, sheet passing portion and non-sheet-passing portion, but the recording material is not limited to paper.

One sheet P of sheets P accommodated in a sheet cassette 2 is separated and fed at predetermined control timing by rotation of a feeding roller 3. The sheet P passes through a path including a feeding path a, a registration roller pair 4 and a feeding path b and is introduced at predetermined control timing to a transfer portion (transfer nip) 5 which is a contact portion between the drum 1 and the transfer roller 1*d*. The sheet P is successively subjected to transfer of the toner image formed on the surface of the drum 1 during a process of being nipped and fed at the transfer portion 5.

The sheet P coming out of the transfer portion 5 is separated from the surface of the drum 1 and passes through a feeding path c and then is introduced into a fixing device (heating fixing device, image heating apparatus) 6 in which the toner image (image) formed on the sheet (recording material) P is fixed on the sheet S under application of heat and pressure. The sheet P coming out of the fixing device 6 passes through a feeding path d and is discharged as the image-formed product (resulting product) onto a discharge tray 7. In FIG. 2, an arrow Pa direction is a sheet feeding direction.

(Fixing Device)

Here, with respect to the fixing device 6, a front surface (side) is a surface (side) on an introduction side of the sheet P, a rear surface (side) is a surface (side) opposite from the front surface (side), and left and right are left (L) and right (R) as seen from the front side. A longitudinal direction is an axial direction or a generatrix direction of a rotatable member, and a short side direction is a direction perpendicular to the longitudinal direction. Up (upper) and down (lower) are up (upper) and down (lower) with respect to a direction of gravitation. These are also true for constituent members of the fixing device 6.

Further, an upstream side and a downstream side are an upstream side and a downstream side with respect to the sheet feeding direction Pa. One end side and the other end side are one end side and the other end side with respect to the longitudinal direction, and in this embodiment, a left side is one end side (non-driving side, front side), and a right side is the other end side (driving side (where a driving force is received), rear side). A width of the sheet P is a sheet dimension on a sheet surface with respect to a direction perpendicular to the sheet feeding direction Pa.

Figure 3:
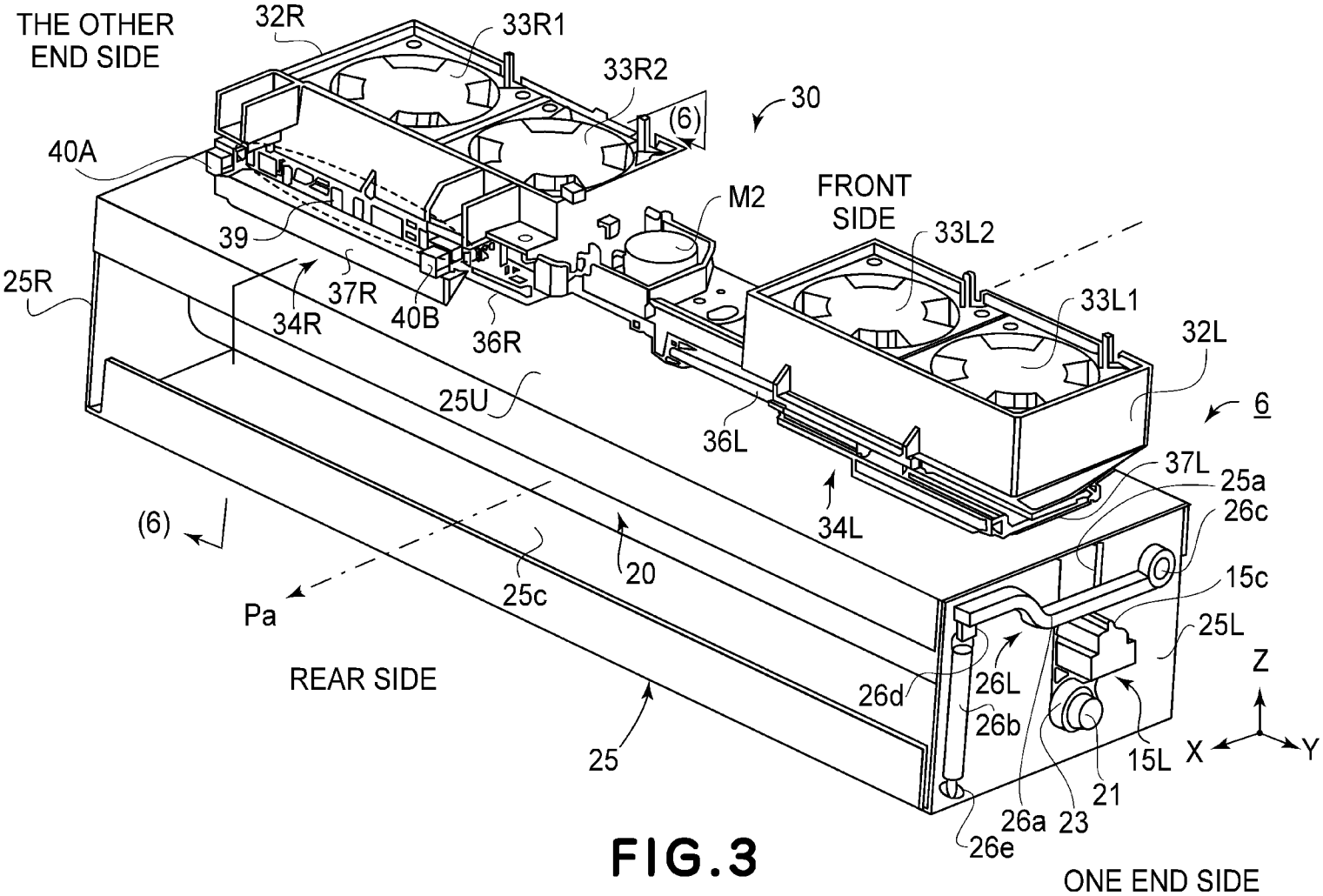
FIG. 3 is a schematic perspective view of an outer appearance of the fixing device on a rear side, one end side and an upper surface side.
Figure 4:
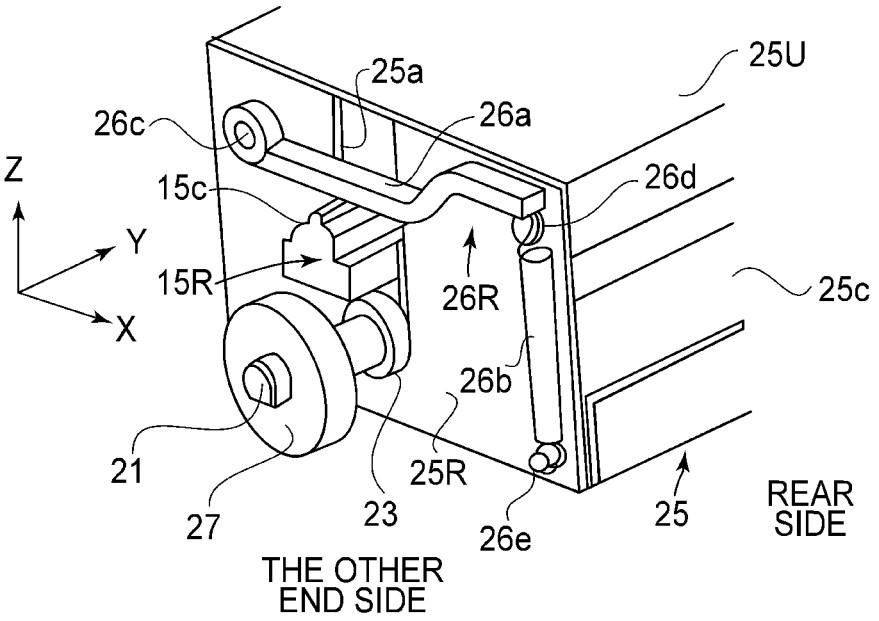
FIG. 4 is a schematic perspective view of an outer appearance of the fixing device on the other end side.
Figure 5:
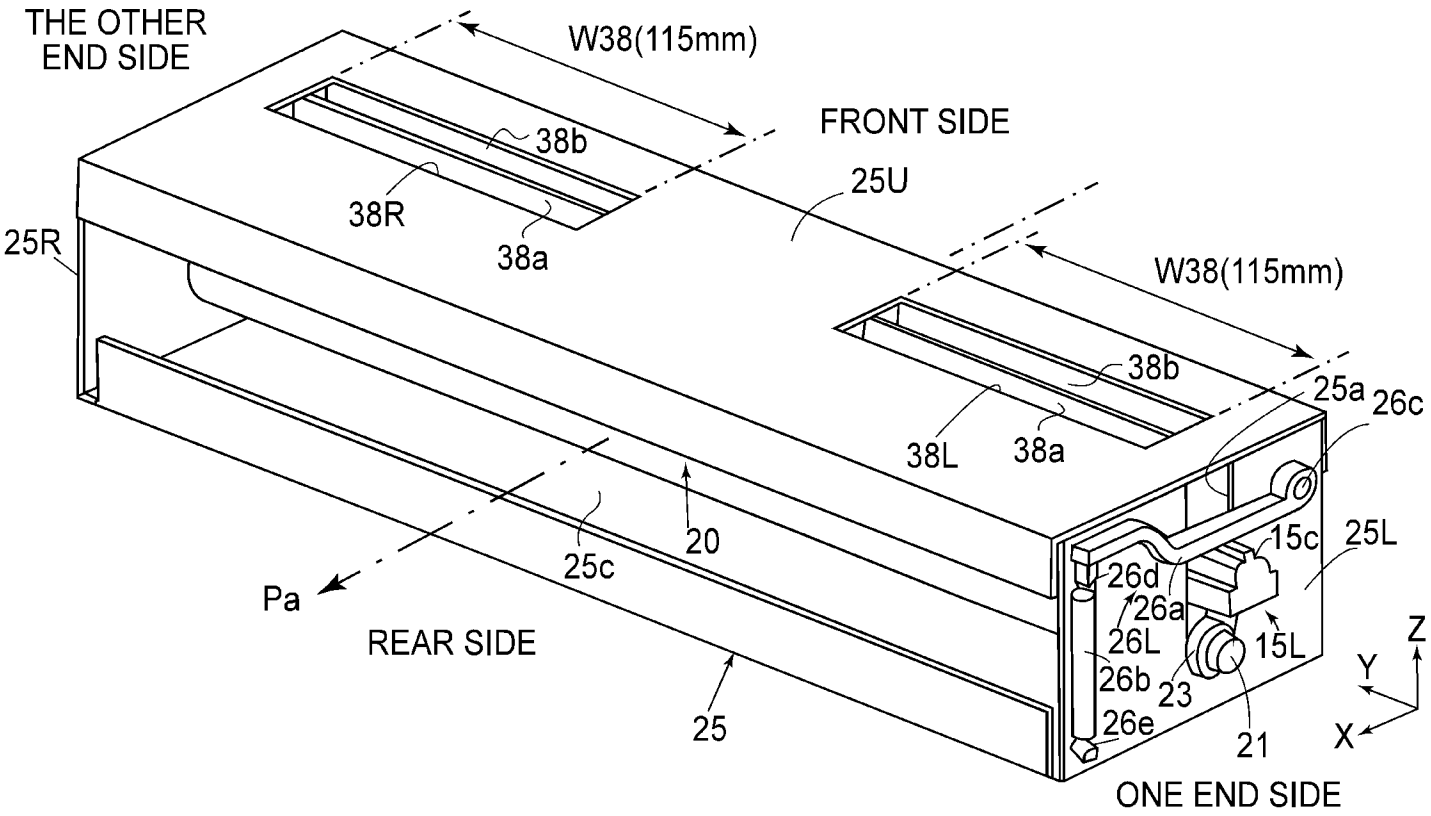
FIG. 5 is a schematic perspective view showing a state of the fixing device of FIG. 3 from which an air blowing cooling mechanism provided on an upper surface side of a device frame is removed.
Figure 6:
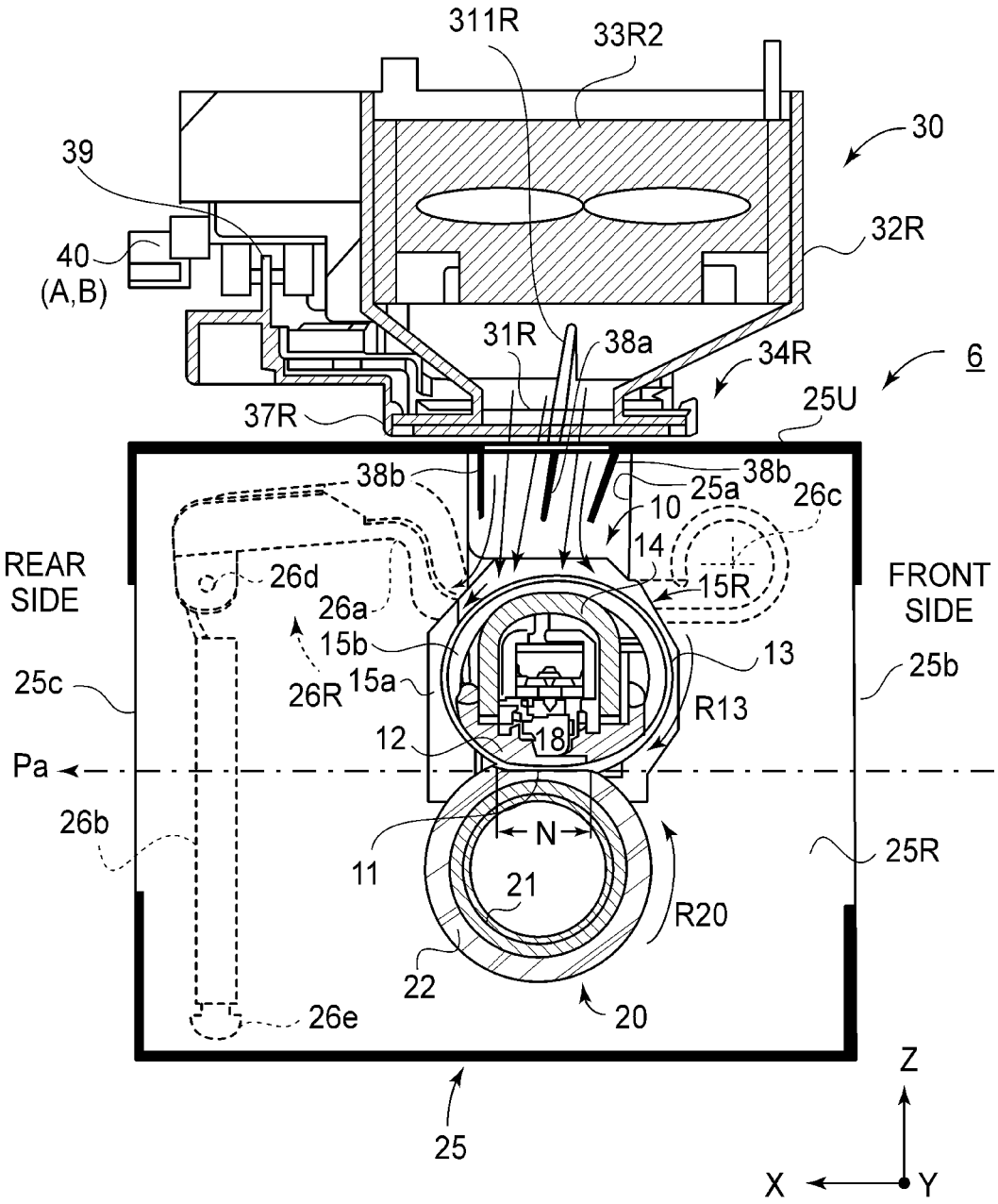
FIG. 6 is a schematic sectional view of the fixing device taken along (6)-(6) line of FIG. 3, in which a shutter is open.
Figure 7:
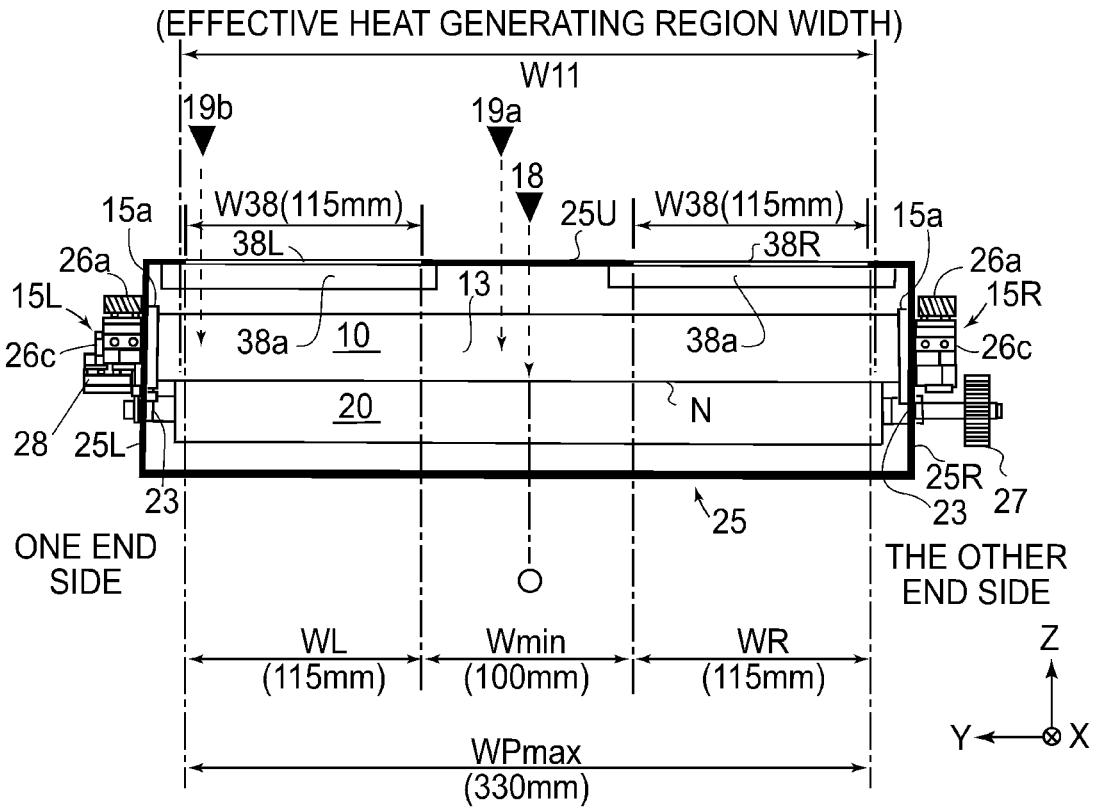
FIG. 7 is a schematic front view of the fixing device of FIG. 5 which is partially cut away.
Figure 8:
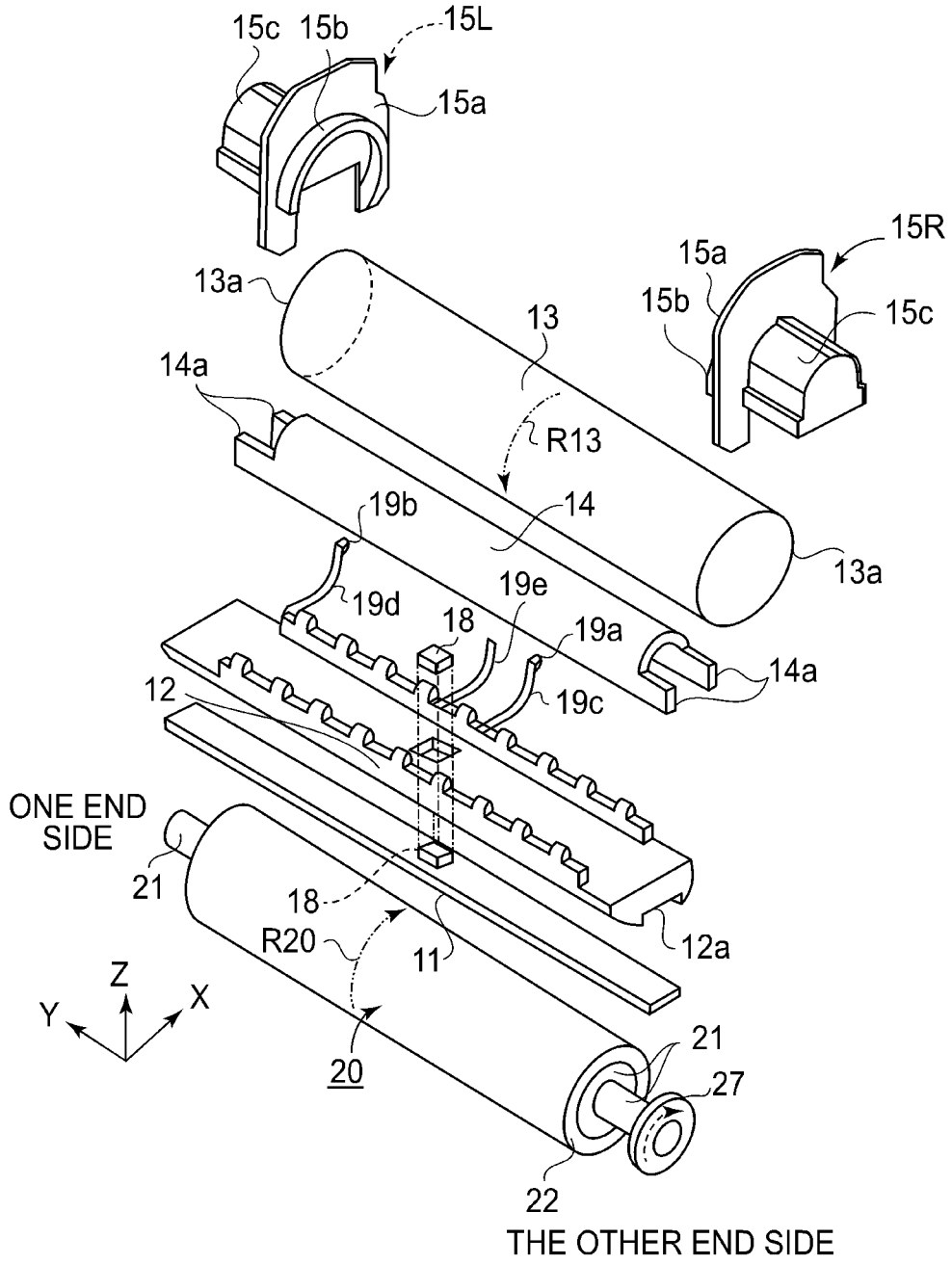
FIG. 8 is a schematic exploded perspective view of a fixing assembly (fixing member).
Figure 9:
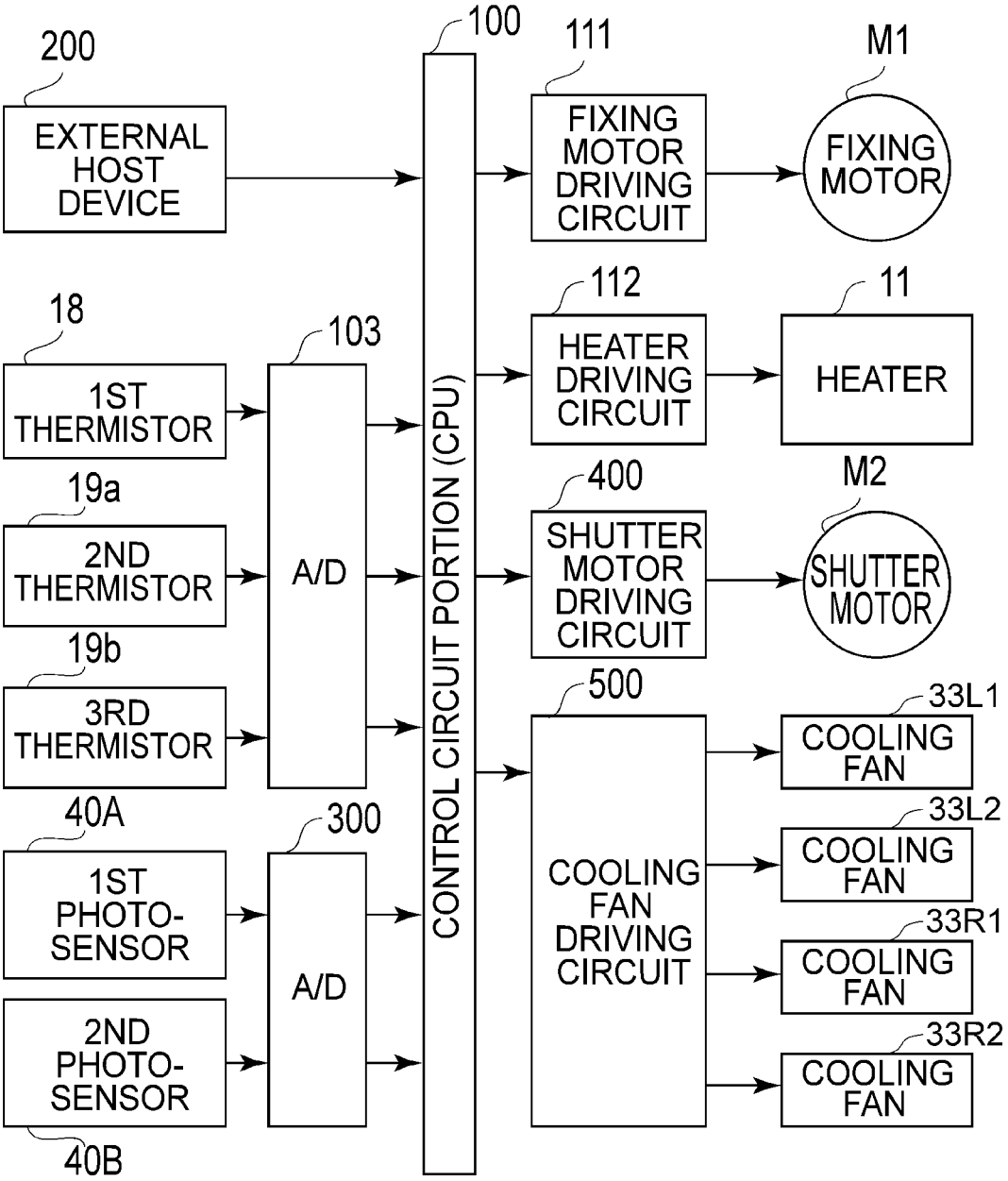
FIG. 9 is a block diagram of a control system principally of the fixing device.

FIG. 3 is a schematic perspective view of an outer appearance of the fixing device 6 on a rear side, one end side and an upper surface side. FIG. 4 is a schematic perspective view of an outer appearance of the fixing device 6 on the other end side. FIG. 5 is a schematic perspective view showing a state of the fixing device 6 of FIG. 3 from which an air blowing cooling mechanism 30 provided on an upper surface side of a device frame is removed. FIG. 6 is a schematic sectional view of the fixing device 6 taken along (6)-(6) line of FIG. 3. FIG. 7 is a schematic front view of the fixing device 6 of FIG. 5 which is partially cut away. FIG. 8 is a schematic exploded perspective view of a fixing assembly. FIG. 9 is a block diagram of a control system principally of the fixing device 6.

This fixing device 6 is an image heating apparatus of a film heating type. The fixing device 6 roughly includes a fixing assembly (fixing member) 10 provided with a fixing film 13, a pressing roller (fixing member) 20 having elasticity, a (fixing) device frame (device casing) 25 accommodating these members 10 and 20, and an air blowing cooling mechanism 30. In the following, the fixing assembly 10 is similarly referred to as the assembly 10. A nip (fixing nip) N is formed by cooperation between the fixing film 13 (rotatable heating member: first rotatable member) and the pressing roller 20 (rotatable pressing member: second rotatable member) which are used as a pair of rotatable members) (FIGS. 6 and 7).

The nip N is a portion where the sheet P carrying thereon an unfixed toner image is nipped and fed and thus the toner image is fixed on the sheet P under application of heat and pressure. In the nip N, the fixing film (fixing belt) 13 contacts the surface of the sheet P on which the unfixed toner image is carried.

The assembly 10 is, as shown in FIG. 6, an assembly of a cylindrical (endless, endless belt-shaped) fixing film 13, a heater 11, a heat-insulating holder 12, a pressing stay (metal stay) 14, fixing flanges 15 (L, R) and the like. FIG. 8 is an exploded perspective view of this assembly 10, and the pressing roller 20 is also illustrated together with the assembly 10.

(1) Fixing Film

The fixing film (fixing belt, flexible sleeve, hereinafter referred to as a film) 13 is a thin endless heat transfer member having flexibility and a heat-resistant property, and assumes a substantially cylindrical shape in a free state thereof by its own elasticity.

The film 13 is a heat-resistant film of 200 μm or less in thickness in order to enable quick start. The film 13 is formed of, as a material of a base layer, a heat-resistant resin material such as polyimide, polyamideimide or PEEK (polyether ether ketone), or pure metal, having a heat-resistant property and a high heat transfer property, such as SUS (stainless steel), Al, Ni, Cu or Zn, or an alloy of these metals.

In the case of the base layer made of the resin material, in order to improve the heat transfer property, heat transfer powder of BN, alumina, Al or the like may also be mixed in the base layer. Further, in order to constitute fixing device having a long lifetime, as a film 13 having sufficient strength and excellent in durability, the film 13 may preferably have a total thickness of 100 μm or more. Therefore, as the total thickness of the film 13, a total thickness of 100 μm or more and 200 μm or less is an optimum thickness.

Further, with a smaller diameter of the film 13, a cost is lower from the viewpoint of a material cost, and thermal capacity becomes lower and therefore a time until a temperature of the film 13 reaches a predetermined temperature is shortened. In this embodiment, a film of 25 mm in outer diameter is employed.

Further, in order to prevent offset and to ensure a separating property of the sheet P, as a surface layer, a parting layer made of a heat-resistant resin material having a good parting property, which is a fluorine-containing resin material such as PTFE, PFA, FEP, ETFE, CTFE or PVDF or a silicone resin material is formed and coated on the base layer singly or in mixture. In this embodiment, the surface layer is constituted by a material at least containing PTFE and PFA.

Here, PTFE is polytetrafluoroethylene, PFA is a tetrafluoroethylene-perfluoroalkylvinyl ether copolymer, and FEP is a tetrafluoroethylene-hexafluoropropylene copolymer. Further, ETFE is an ethylenetetrafluoroethylene copolymer, CTFE is polychlorotrifluoroethylene, and PVDF is poly (vinylidene fluoride).

As a coating method, the parting layer may be coated on an outer surface of the film 13 after being subjected to etching, by dipping, powder spraying or the like. Or, a type in which the surface of the film 13 is coated with a resin material formed in a tube shape may also be employed. Or, a method in which the outer surface of the film 13 is subjected to blasting and thereafter a primer layer of an adhesive is coated on the blasted surface of the film 13 and then the parting layer is coated on the primer layer may also be employed.

(2) Heater

The heater 11 is an elongated plate-shaped heat generating element in which a full length portion having an effective heat generating region width W11 (FIG. 7) is abruptly increased in temperature by energization and which has low thermal capacity, and is a ceramic heater in this embodiment. In this heater 11, the heat generating element (heat generating resistor, an energization heat generating resistor layer) is formed by printing electroconductive paste of Ag—Pd or the like in a thick film (layer) on an elongated thin plate-shaped substrate (ceramic substrate) of AlN (aluminum nitride) having a good heat-transfer property.

Then, on the heat generating elements, as a slidable insulating member, an about 50-60 μm thick glass coating layer is provided integrally with the heat generating element, so that the ceramic heater is constituted. In this embodiment, the glass coating layer side is a heater front surface side and the ceramic heater contacts an inner surface of the film 13 on this side.

The heat generating element is formed along the longitudinal direction of the substrate in a length corresponding to a width of a maximum-width size sheet usable in the fixing device or a length longer than the above length by a predetermined distance. A length range of this heat generating element is the effective heat generating region width W11 of the heater 11. In the heater 11, on the substrate (on the heater rear surface side) opposite from a side where the heat generating element is provided, a chip-shaped thermistor (first thermistor) 18 (FIGS. 6 and 8) as a temperature detecting element is provided while sandwiching the substrate between itself and the heat generating element. This thermistor 18 is fixed to the substrate (heater rear surface) with predetermined pressure by a pressing means (not shown) such as a spring.

(3) Heating Insulating Holder

The heat insulating holder (heater holding member, hereinafter referred to as a holder) 12 is an elongated member extending along the longitudinal direction (widthwise direction) of the film 13 and is formed of a heat-resistant resin material such as a liquid crystal polymer, a phenolic resin, PPS or PEEK. With a decreasing thermal conductivity, heat of the heater 11 is less taken, so that heat can be efficiently conducted to the film 13, and therefore, a filler such as a glass balloon or a silica balloon may also be incorporated in the resin layer. The heater 11 is engaged in and held by a groove 12*a* (FIG. 8) formed on a lower surface of the holder 12 along the longitudinal direction of the holder 12 in a state in which a front surface thereof faces the inner surface of the film 13. Further, the holder 12 also has a function of guiding rotation of the film 13.

(4) Pressing Stay

The pressing stay 14 is a rigid member which extends along the longitudinal direction of the film 13 and which receives a reaction force from the pressing roller 20, and may desirably be formed of a material which is not readily flexed even under application of a high pressure. In this embodiment, the stay 14 is a metal stay and uses a molded member of SUS 304 having a U-shape in cross section. The stay 14 is provided on an upper surface side of the holder 12 and contacts the holder 12, so that flexure and twisting of an entirety of the assembly 10 are suppressed.

(5) Fixing Flanges

The film 13 is externally engaged (fitted) loosely with an assembly (assembled member) of the heater 11, the holder 12 and the stay 14. Both end portions 14*a* (FIG. 8) of the stay 14 project toward outsides of the film 13 through openings formed at both end portions of the film 13, fixing flanges 15(L, R) on one end side and the other end side, respectively, are engaged with the associated end portions 14*a*, respectively, of the stay 14. The film 13 is positioned between opposing end portion regulating (preventing) surfaces (opposing collar seat portions) 15*a* of the engaged flanges 15(L, R).

The flanges 15(L, R) are regulating (preventing) members for regulating (preventing) movement of the film 13 in the longitudinal direction and a shape of the film 13 with respect to a circumferential direction and are molded products of a heat-resistant resin material such as PPS, the liquid crystal polymer, the phenolic resin or the like. Each of the flanges 15(L, R) includes the end portion regulating surface 15*a*, an inner periphery regulating surface 15*b* and a portion-to-be-pressed (pressure-receiving portion) 15*c*.

(6) Pressing Roller

The pressing roller 20 as the rotatable member is an elastic roller including a core metal 21 of SUS, SUM (sulfur and sulfur composite free-cutting steels), Al or the like and including an elastic layer 22, formed outside the core metal 21, such as an elastic solid rubber layer, an elastic sponge rubber layer or an elastic foam rubber layer.

Here, the elastic solid rubber layer is formed of a heat-resistant rubber such as a silicone rubber or a fluorine-containing rubber. Further, the elastic sponge rubber layer is formed by foaming a silicone rubber in order to impart an heat-insulating effect. Further, the elastic foam rubber layer is formed by dispersing a hollow filler (microballoons or the like) in a silicone rubber layer, so that a hardened product is provided therein with a gas portion and thus the heat-insulating effect is enhanced. On these layers, a parting layer of a perfluoroalkoxy resin (PFA), polytetrafluoroethylene resin (PTFE) or the like may also be formed.

The pressing roller 20 is supported between side plates 25(L, R) on one end side and the other end side of the device frame 25 so as to be rotatable via bearings 23 on one end side and the other end side of the core metal 21.

The assembly 10 is disposed between the side plates 25(L, R) in parallel to the pressing roller 20 so that the heater 11 side is opposed to an upper side of the pressing roller 20. The flanges 15(L, R) in the assembly 10 are engaged with guiding holes 25*a* formed symmetrically in the side plates 25(L, R) so that the portions-to-be-pressed 15*c* thereof are slidable (movable) in a direction toward the pressing roller 20.

Then, the flanges 15(L, R) receive predetermined pressing forces in the direction toward the pressing roller 20 at the portions-to-be-pressed 15*c* by pressing arms 26*a* of a pressing mechanism 26 on one end side and the other end side. By the pressing forces, an entirety of the flanges 15(L, R), the stay 14, the holder 12 and the heater 11 of the assembly 10 is pressed in the direction toward the pressing roller 20. For that reason, a part of the heater 11 and a part of the holder 12 are pressed toward the pressing roller 20 through the film 13 against elasticity of the elastic layer 22 by the predetermined pressing forces. As a result, the nip N with a predetermined width with respect to the sheet feeding direction Pa is formed between the film 13 and the pressing roller 20.

Referring to FIGS. 3 and 4, outside the side plates 25(L, R) on one end side and the other end side of the frame 25, the pressing mechanisms 26(L, R) on one end side and the other end side are provided, respectively. These pressing mechanisms 26(L, R) have a mirror symmetrical constitution and have the same structure.

Each of the pressing mechanisms 26(L, R) includes a pressing lever (arm) 26*a* and a pressing spring 26*b*. The lever 26*a* is mounted to the associated one of the side plates 25(L, R) on a base portion side thereof so s to be swingable about a shaft portion 26*c*. The lever 26*a* extends from the shaft portion 26*c* to a side opposite from the shaft portion 26*c* side via an upper side of the associated one of the portions-to-be-pressed 16*c* of the flanges 15(L, R).

The spring 26*b* is an elastic member for rotationally urging the lever 26*a* about the shaft portion 26*c* in a pressing (urging) direction by bringing the lever 26*a* into contact with the associated one of the portions-to-be-pressed 15*c* of the flanges 15(L, R). In this embodiment, the spring 26*b* is stretched between a free end portion 26*d* and a pin shaft 26*e* implanted in the associated one of the side plates 25(L, R). Accordingly, the lever 26*a* is contacted to the associated one of the portions-to-be-pressed 15*c* of the flanges 15(L, R) by a tensile force of the spring 26 and imparts the predetermined pressing force to the associated portion-to-be-pressed 15*c*.

The lever 26*a* is supported rotatably relative to the associated one of the side plates 25(L, R), so that rotational moment generates about the shaft portion 26*c* by the tensile force of the spring 26*b* and thus the associated one of the flanges 15(L, R) is pressed in the direction toward the pressing roller 20 by the pressing force.

(7) Fixing Operation

On the other end side (driving side) of the core metal 21 of the pressing roller 20, a driving gear 27 (FIGS. 4 and 8) is provided concentrically integral with the core metal 21. To this gear 27, a driving force of a fixing motor (driving source) M1 driven by a fixing motor driving circuit 111 controlled by the control circuit portion 100 (FIG. 9) is transmitted through a drive transmitting mechanism (not shown). As a result, the pressing roller 20 is rotationally driven as a rotatable driving member at a predetermined speed in the counterclockwise direction of an arrow R20 shown in FIG. 6.

By rotationally driving the pressing roller 20, rotational torque acts on the film 13 in the nip N by a frictional force between the film 13 and the pressing roller 20. The pressing roller 20 functions as a rotatable member for rotating the film 13. The film 13 is rotated by the pressing roller 20. As a result, the film 13 is rotated around the assembly of the heater 11, the holder 12 and the stay 14 in the clockwise direction of an arrow R13 shown in FIG. 6 while an inner surface of the film 13 slides on the part of the heater 11 and the part of the holder 12 in the nip N in close contact with the part of the heater 11 and the part of the holder 12. A rotational peripheral speed of the film 13 substantially corresponds to a rotational peripheral speed of the pressing roller 20.

The end portion regulating (preventing) surfaces 15*a* of the flanges 15(L, R) contact end surfaces (edge surfaces) 13*a* (FIG. 8) of the rotating film 13 and thus prevent movement of the film 13 in the longitudinal direction (thrust direction) of the film 13. The inner periphery regulating surfaces 15*b* are guiding surfaces for supporting an inner peripheral surface of the film 13 at end portions of the film 13 from an inside of the film 13, and are provided as arcuately projected edge portions toward the inner surface side of the flanges 15(L, R). Between the film 13 and the heater 11, a lubricant such as heat-resistant grease of a fluorine-containing type, a silicone type or the like is interposed, whereby a friction resistance is suppressed to a low level and thus the film 13 is rotatable (movable) smoothly.

The control circuit portion 100 controls a heater driving circuit portion 112 and thus starts energization to the heater 11. Although an energization path from the heater driving circuit portion 112 toward the heater 11 is omitted from illustration, the energization is carried out via wiring electrically connecting the heater driving circuit portion 112 with the heater 11 and a connector 28 (FIG. 7). By this energization, a full length region of the effective heat generating region W11 (FIG. 7) of the heater 11 abruptly increases in temperature.

A temperature of the heater 11 is detected by the first thermistor 18 provided on the rear surface of the heater 11, so that detection temperature information is inputted to the control circuit portion 100 through an A/D converter 103. Further, inner surface temperatures of the film 13 rotating while being heated by the heater 11 are detected by second and third thermistors 19*a* and 19*b* (FIGS. 7 and 8), so that pieces of detection temperature information are inputted to the control circuit portion 100 through the A/D converter 103.

The control circuit portion 100 determines and appropriately controls a duty ratio, wave number and the like of a voltage applied from the heater driving circuit 112 to the heater 11, depending on the pieces of the detection temperature information (outputs) inputted from the first to third thermistors 18, 19*a* and 19*b*. As a result, the temperature in the nip N is increased to a predetermined fixing set temperature, so that temperature control is carried out.

In the above state of the fixing device 6, the sheet P on which the unfixed toner image is formed is introduced from the image forming portion A1 into the fixing device 6 through an introducing port 25*b* (FIG. 6) on the front side of the frame 25 and is nipped and fed through the nip N. To the sheet P, heat of the heater 11 is imparted through the film 13 in a process in which the sheet P is nipped and fed through the nip N. The unfixed toner image is melted by the heat of the heater 11 and is fixed as a fixed image on the sheet P by heat and pressure applied to the nip N. Then, the sheet P coming out of the nip N is discharged to an outside of the fixing device 6 through a discharging port 25*c* of the device frame 25.

Incidentally, inside the frame 25, a sheet guiding member, a sheet sensor and the like are provided between the introducing port 25*b* and the nip N, and a sheet guiding member, a discharging roller pair, a sheet sensor and the like are provided between the nip N and the discharging port 25*c*, but these members are omitted from the figures.

Here, in this embodiment, the sheet P is fed to the fixing device 6 on a so-called center (line) feeding basis. Here, center (line) feeding refers to a method in which when sheets different in size are fed, these sheets are fed so that centers (center lines) of the respective sheets with respect to the widthwise direction (perpendicular to the recording material (sheet) feeding direction) of the sheets coincide with each other. In FIG. 7, "O" represents a reference line (center reference line, phantom line) as the center line in the center (line) feeding.

In FIG. 7, "WPmax" is a sheet passing region width of a maximum width sheet usable in the apparatus. In this embodiment, the width of the maximum width sheet usable in the apparatus is 330 mm. "WPmin" is a sheet passing region width of a minimum width sheet usable in the apparatus. In this embodiment, the width of the minimum width sheet usable in the apparatus is 100 mm which is a postcard width. In the case where the minimum width sheet is fed by the center (line) feeding (sheet passing) basis, with respect to the widthwise direction, non-sheet-passing portions exist outside WPmin on both sides (one end side and the other end side).

The effecting heat generating region width W11 of the heater 11 is set so as to be equal to the sheet passing region width WPmax or larger than the sheet passing region width WPmax by a predetermined width. The first thermistor 18 is disposed in contact with the rear surface of the heater 11 at a heater rear surface position substantially corresponding to the center reference line O.

The second thermistor 19*a* detects the film temperature in contact with the inner surface of the film 13 at a position which is downstream of the nip N with respect to the film rotational direction and which substantially corresponds to the center reference line O. The third thermistor 19*b* detects the film temperature in contact with the inner surface of the film 13 at a position which is downstream of the nip N with respect to the film rotational direction and which substantially corresponds to an inside position of an end of the sheet passing region width WPmax.

That is, the second thermistor 19*a* detects a temperature of a film portion corresponding to a portion within the sheet passing region width WPmax which is a sheet passing portion common to any sheets having large and small (various) sizes usable in the apparatus. The third thermistor 19*b* detects a temperature of a film portion corresponding to the non-sheet-passing portion when a sheet narrower in width than the maximum width sheet is passed through the nip N (FIG. 7).

The second and third thermistors 19*a* and 19*b* are supported at free end portions of elongated spring members 19*c* and 19*d*, respectively (FIG. 8). Base portions of the spring members 19*c* and 19*d* are fixed to the holder 12. That is, the second and third thermistors 19*a* and 19*b* are supported by the spring members 19*c* and 19*d*, respectively, so as to elastically contact and slide with the inner surface of the film 13. Further, the second and third thermistors 19*a* and 19*b* are mounted so that in a free state, free ends thereof project with a spring property to an outside of a projection shape of the film 13 during mounting of the film 13.

Further, the stay 14 made of metal is provided with a grounding member 19*e* (FIG. 8) contacting the inner surface of the film 13 in the neighborhood of the second thermistor 19*a* for the purpose of establishing the grounding of the film 13. The grounding member 19*e* is an elongated spring member in which a base portion is electrically conducted to the stay 14 and a free end portion slides with the inner surface of the film 13 in elastic contact with the film inner surface. This grounding member 19*e* is also mounted similarly as in the case of the second and third thermistors 19*a* and 19*b* so that in a free state, a free end thereof projects with a spring property to the outside of the projection shape of the film 13 during the mounting of the film 13.

Here, the above-described fixing device 6 is prepared by assembling the device frame 25 including the fixing assembly 10 and the pressing roller 20 and also including a second louver portion described later into a unit, excluding the air blowing cooling mechanism 30, mountable to and dismountable from the image forming apparatus main assembly. Even when the device frame 25 is dismounted as the unit from the image forming apparatus main assembly, the air blowing cooling mechanism 30 is left on the image forming apparatus main assembly side.

(Air Blowing Cooling Mechanism)

The air blowing cooling mechanism 30 will be described. The air blowing cooling mechanism 30 is a cooling means for preventing the non-sheet-passing portion temperature rise of the assembly 10 occurring when sheets narrower in width than the maximum width sheet usable in the apparatus are continuously passed through the nip N.

The air blowing cooling mechanism 30 includes ducts 32(L, R) provided with air blowing ports 31(L, R) and fans 33(L, R) for blowing air toward the air blowing ports 31(L, R) through the ducts 32(L, R) in order to cool predetermined regions of the film 13 which is the rotatable heating member.

Further, the air blowing cooling mechanism 30 includes first shutter members 37(L, R) having first surfaces for closing the air blowing ports 31(L, R) in closing positions for closing the air blowing ports 31(L, R) and includes second shutter members 36(L, R) having second surfaces for closing the air blowing ports 31(L, R) in a closing position for closing the air blowing ports 31(L, R).

Figure 12:
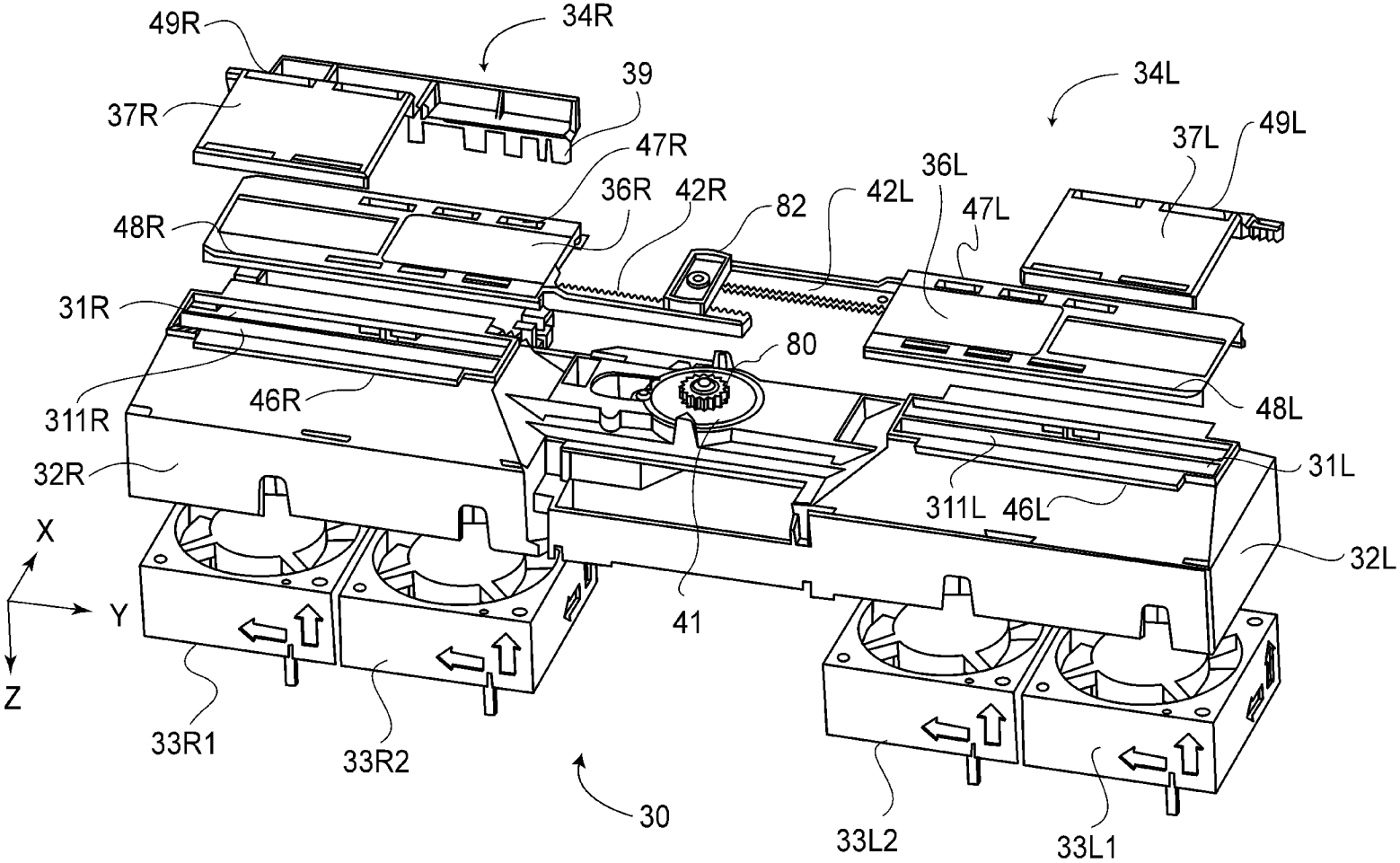
FIG. 12 is an exploded perspective view of the air blowing cooling mechanism of FIG. 11.
Figure 14:
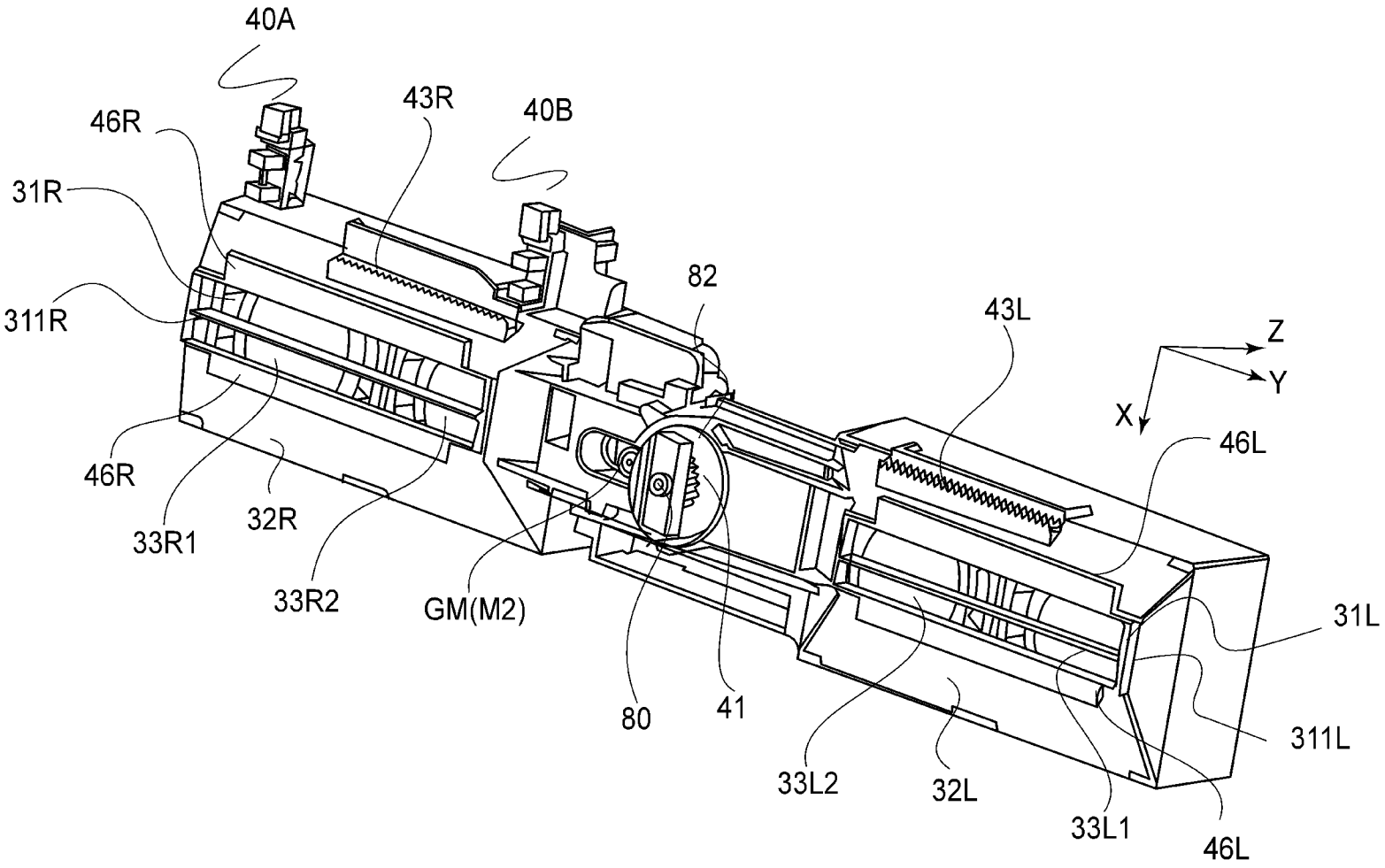
FIG. 14 is a perspective view showing an air blowing cooling mechanism portion which is a portion of the air blowing cooling mechanism of FIG. 11 from which a shutter member is removed, in which the air blowing cooling mechanism portion is seen from the air blowing port side.

The ducts 32(L, R) include air blowing ports (exhaust ports) 31(L, R) which correspond to the window holes 38(L, R) of the upper surface plate 25U, respectively, on a lower surface side thereof and which extend in the left-right direction (FIGS. 12 and 14). Upper surfaces of the ducts 32(L, R) are open as (air) inlet port surface.

The duct 32 is provided with dust-side louvers 311(L, R) as first louver portions for rectifying the cooling air blown from the fans 33. The dust-side louvers 311(L, R) are rib-shaped portions provided in parallel to or with a predetermined angle relative to the air blowing direction of the fans 33 from free ends of air blowing portions of the fans 33 toward the air blowing ports 31(L, R) in the ducts 32. By appropriately setting the rib-shaped portions of the dust-side louvers 311(L, R) and opening areas of the air blowing ports 31, a speed and a volume (amount) of the cooling air from the air blowing cooling mechanism 30 toward the fixing device 6 are controlled.

The air blowing cooling mechanism 30 is supported by a supporting member (not shown) on an upper side of an upper surface plate (top plate) 25U of the frame 25 and is provided close to the upper surface plate 25U in a predetermined manner. The air blowing cooling mechanism 30 has an inlet port surface on the upper side thereof and an air blowing port surface on a lower side thereof, and the air blowing port surface of the air blowing cooling mechanism 30 is provided opposed to and in proximity to the upper surface of the upper surface plate 25U in a predetermined manner.

Figure 10:
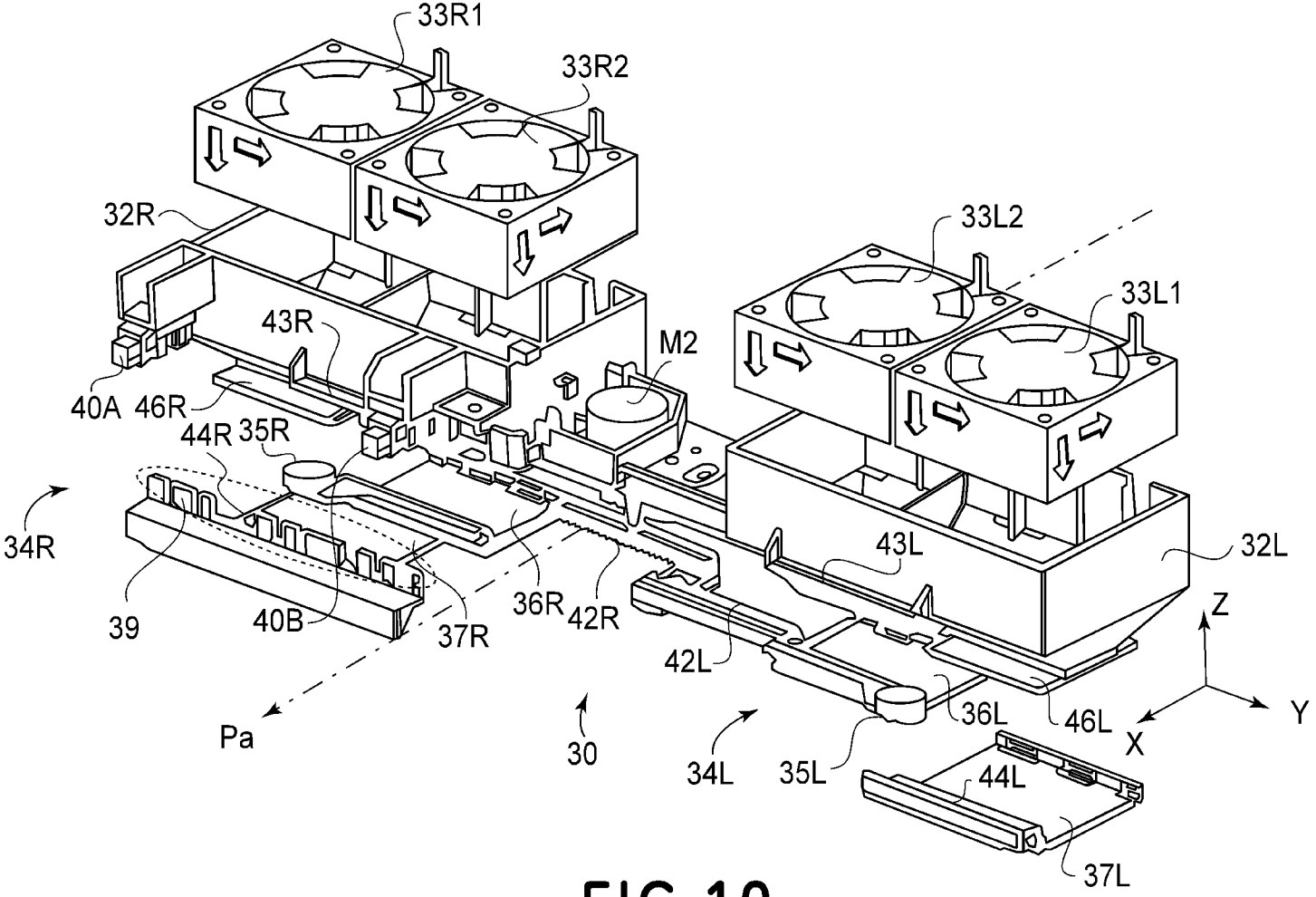
FIG. 10 is an exploded perspective view of the air blowing cooling mechanism of FIG. 3 as seen form an inlet (intake) port side.
Figure 11:
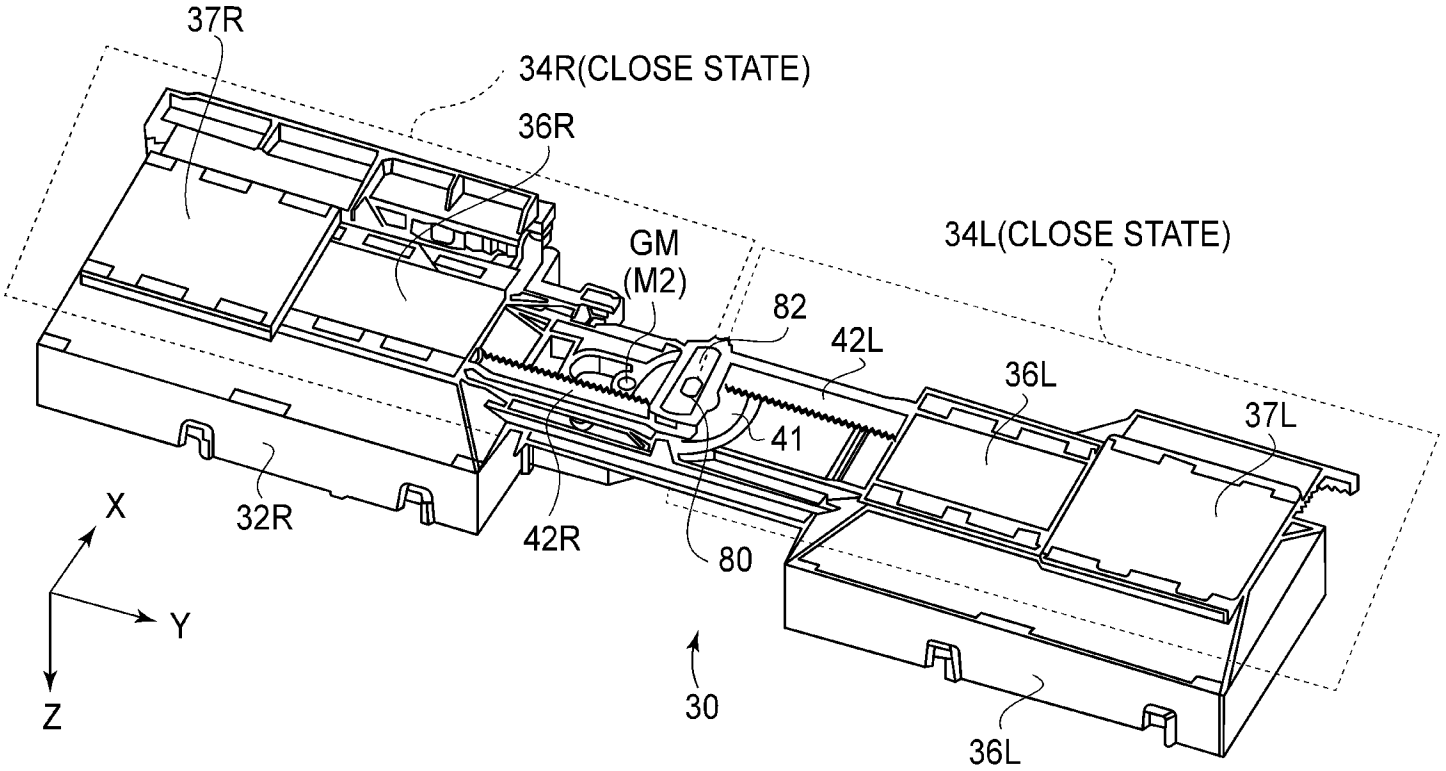
FIG. 11 is a perspective view of the air blowing cooling mechanism of FIG. 3 which is turned upside down and which is as seen from an air blowing port side, in which a shutter mechanism is in a shutter member close state.
Figure 13:
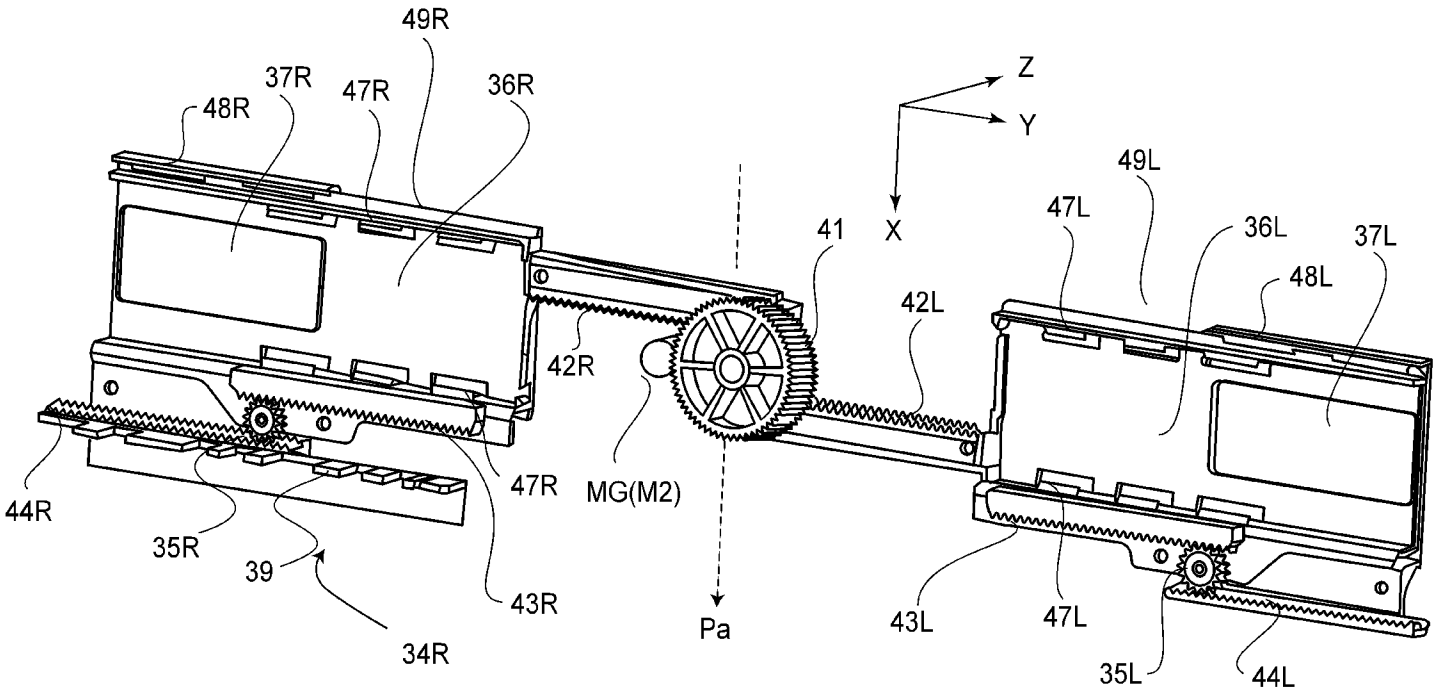
FIG. 13 is a perspective view showing only the shutter mechanism as seen from an inside of the shutter mechanism.

FIG. 10 is an exploded perspective view of the air blowing cooling mechanism 30 of FIG. 3 as seen form an inlet (intake) port side. FIG. 11 is a perspective view of the air blowing cooling mechanism 30 of FIG. 3 which is turned upside down and which is as seen from an upward air blowing port side, in which shutter mechanisms 34(L, R) described later are in a shutter member close state. FIG. 12 is an exploded perspective view of the air blowing cooling mechanism 30 of FIG. 11. FIG. 13 is a perspective view showing only the shutter mechanisms 34(L, R) as seen from an inside of the shutter mechanisms 34(L, R).

FIG. 14 is a perspective view showing an air blowing cooling mechanism portion, which is a portion of the air blowing cooling mechanism 30 of FIG. 11, from which shutter members 36L, 37L, 36R and 37R of the shutter mechanisms 34(L, R) are removed and in which the air blowing cooling mechanism portion is seen from the air blowing port side. Parts (a) and (b) of FIG. 15 are schematic views showing a full-open state and a full-close state, respectively, of the shutter mechanism.

As shown in FIG. 5, the upper surface plate 25U is provided with two elongated window holes 38(L, R), extending in the left-right direction on a left-half portion side and a right-half portion side, respectively, for causing cooling air to act on the non-sheet-passing portions of the assembly 10, respectively, by the air blowing cooling mechanism 30. These two window holes 38(L, R) are disposed bilaterally symmetrically with respect to the reference line of the center (line) basis feeding of the sheet P.

Each of the window holes 38(L, R) is, as shown in FIG. 7, positioned so as to oppose an upper surface portion of the assembly 10 and is positioned correspondingly to an associated one of a left-side non-sheet-passing region width WL and a right-side non-sheet-passing region width WR when the minimum-size sheets usable in the apparatus are passed through the nip N. In this embodiment, a width dimension (length dimension) W38 of each of the window holes 38(L, R) is 115 mm (=[(330 mm−100 mm)/2].

A second louver portion includes a fixing-side louver 38*a* and walls 38*b* sandwiching the fixing-side louver 38*a* therebetween (FIGS. 1 and 5 to 7). The second louver portion is provided in each of the window holes 38(L, R). The second louver portion may also include a plurality of fixing-side louvers 38*a*. The fixing-side louver 38*a* has a function of rectifying the cooling air blown into the frame 25 through the window holes 38(L, R) by the air blowing cooling mechanism 30. In this embodiment, the fixing-side louver 38*a* and the walls 38*b* extend along a longitudinal direction of the window holes 38(L, R).

In this embodiment, a minimum width W between the fixing-side louver 38*a* and the wall 38*b* may desirably be 15 mm or less. The reason therefor will be described. As regards the fixing-side louver 38*a* provided in the fixing device 6, there is a possibility that the film 13 still has heat depending on a state of the fixing device 6 when the fixing device 6 is dismounted from the image forming apparatus main assembly. For that reason, a possibility that a service person or a user unintendedly inserts his (her) finger(s) into the fixing device 6 through between the fixing-side louver 38*a* and the wall 38*b* and touches the heated film 13 is required to be avoided.

In this embodiment, W is set at 3.5 mm. The reason why W is set at a value less than 10 mm is that a predetermined range of the film 13 is rectified for cooling, and in addition, the speed of the cooling air is increased by setting the air path at a narrowed state. FIG. 6 is a schematic view of the fixing device 6, in which the shutter members are opened compared with the case where the shutter members are closed as in FIG. 1.

As described hereinabove, the inside of the duct 32, the fan 33 is provided, and the air blowing from the fan 33 is rectified by causing the cooling air to first pass through the dust-side louver 311 and then the cooling air is sent toward the fixing device 6. Further, the cooling air passes through the window holes provided in the upper top surfaces 25U of the fixing device 6 and then passes through the fixing-side louver 38*a* and thus is further rectified, so that the cooling air is blown on the film 13 and thus the film 13 is cooled. The air path is gradually narrowed from the dust-side louvers 311 to the fixing-side louver 38*a*, whereby the air speed is increased while minimizing loss due to formation of the air path and thus the film 13 can be efficiently cooled.

By employing such a constitution, even when the film 13 has the small diameter, the cooling air can be efficiently blown on the film 13 by the air path to the film 13. In addition, the volumes of the air on an upstream side and a downstream side of the film 13 with respect to a rotational direction can be controlled.

In FIG. 6, setting is made so that the volume of the air on the rear side, i.e., the downstream side of the film 13 with respect to the rotational direction becomes large. This is because an air flow system (not shown in this embodiment) for exhausting the heat, generated from the fixing device 6, to an outside of the image forming apparatus is provided on the rear side.

Further, the shutter member 36 is disposed between the dust-side louver 311 and the fixing-side louver 38*a*. For example, it would also be considered that the shutter member 36 is disposed between the fan 33 and the dust-side louver 311, but it is preferable that a size of the shutter member 36 is such that an entire area of the fan 33 is covered with the shutter member 36, and therefore, a shape of the shutter member 36 becomes large.

Further, in the case where the shutter member 36 is disposed between the fixing-side louver 38*a* and the film 13, the shutter member 36 is disposed inside the fixing device 6. In this case, for example, when the fixing device 6 is exchanged due to an end of a lifetime of the fixing device 6, there is a liability that the fixing device 6 is exchanged together with an unnecessary shutter member and thus a running cost becomes high. Further, when the shutter member is shaped along a cylindrical shape of the film 13, there is also a liability that the shape of the shutter member becomes complicated.

(1) Shutter and Cooling Fan Constitution

Arrangements of the shutter members and the cooling fans of the cooling apparatus 30 are symmetrical with respect to a rectilinear line passing through a rotation center of a driving pinion gear (driving member) 41 and therefore the arrangement on a right-half portion side will be described as a representative example. Particularly, in the case where there is no description, a left-half portion and a right-half portion have the same constitution.

Inside the right(-side) duct 32R, two right(-side) cooling fans 33(R1, R2) for blowing cooling air to this right duct 32R are provided along the left-right direction. Further, the right duct 32R includes a partition portion provided at a position corresponding to a boundary between the cooling fans 33(R1, R2), so that the air of each of the fans 33(R1, R2) is guided into the air blowing port 31R.

Further, the air blowing cooling mechanism 30 includes the shutter mechanism 34 functioning as an opening width adjusting mechanism for adjusting an opening width of the air blowing port 31L and an opening width of the air blowing port 31R. The shutter mechanism 34 is constituted by a left shutter mechanism 34L for limiting a cooling range of the cooling air sent through the left duct 32L and by a right shutter mechanism 34R for limiting a cooling range of the cooling air sent through the right duct 32R.

The right shutter mechanism 34R including two shutter members is consisting of an outer shutter member (first shutter member) 37R provided on a longitudinal outer side of the assembly 10 and an inner shutter member (second shutter member) 36R provided on a longitudinal central (inner) side of the assembly 10. Further, the right shutter mechanism 34R is constituted by a shutter pinion gear 35R rotatably supported by the inner shutter member 36R, the driving pinion gear 41, a rack-shaped portion (rack teeth) 43R formed in the duct 32R, and the shutter motor M2.

The inner shutter member 36R is provided on the duct 32R in 36R engagement with an inner shutter member regulating portion 46R formed along the longitudinal direction of the air blowing port 31R, and is slidable along the longitudinal direction of the inner shutter member regulating portion 46R.

Further, the outer shutter member 37R engages with collar-shaped outer shutter member regulating portions 49R formed on the inner shutter member 36R with respect to the longitudinal direction of the inner shutter member 36R.

The left-side portion is similarly constituted.

As regards the above-described left and right shutter mechanisms 34(L, R), the driving pinion gear 41 and the shutter motor M2 are constituent members common to the mechanisms 34(L, R). The shutter motor M2 which is a driving source for driving the driving pinion gear 41 of the shutter mechanisms 34(L, R) is provided in the neighborhood of a central portion between the left and right ducts 32L and 32R. The inner shutter members 36(L, R) are provided with the rack-shaped portions 42(L, R) each engaging with the driving pinion gear 41.

The rack-shaped portions 43(L, R) provided on the left and right ducts 32(L, R) are provided so as to engage with the shutter pinion gears 35(L, R) rotatably supported by the shutter members 36(L, R).

The driving pinion gear 41 is rotationally driven normally and reversely by an output gear MG of the shutter motor (pulse motor) M2. in interrelation with normal and reverse rotational drive of this gear 41, the inner and outer shutter members 36(L, R) and 37(L, R) of the left and right shutter mechanisms 34(L, R) are moved as described above for opening and closing the air blowing ports 31(L, R) of the left and right ducts 32(L, R). That is, in this embodiments, the driving pinion gear 41 is a driving member for transmitting drive (driving force) of the shutter motor M2 (output gear MG) which is the driving source to the inner and outer shutter members 36(L, R) and 37(L, R) of the left and right shutter mechanisms 34(L, R).

The inner and outer shutter members 36(L, R) and 37(L, R) of the left and right shutter mechanisms 34(L, R) are controlled so as to be moved to positions corresponding to the width of the sheet P passed through the nip N. As a result, widths of the air blowing ports 31(L, R) of the left and right ducts 32(L, R), i.e., widths of the left and right window holes 38(L, R) in the upper surface plate 25U are adjusted to optimum opening widths corresponding to the passed sheet width, so that air blowing cooling is carried out in ranges in which non-sheet-passing region temperature rise in the assembly 10 occurs.

(2) Shutter (Member) Opening and Closing Operation

A shutter (member) opening and closing operation will be described. The outer shutter member 37R of the right shutter mechanism 34R is provided at a bent edge portion thereof with a plurality of sensor flags 39 (a portion enclosed by a broken line in FIGS. 3 and 10) determined correspondingly to sheets having various width sizes. Further, first and second photo-sensors 40A and 40B for detecting edge portions of the sensor flags 39 are provided by being fixed to the right duct 32R. Edge portion detection information of each of the sensor flags 39 by the first and second photo-sensors 40A and 40B is inputted to the control circuit portion 100 through an A/D converter 300 as shown in FIG. 9.

In this embodiment, the sensor flags 39 and the first and second photo-sensors 40A and 40B are a detecting means for detecting opening (portion) positions of the shutters. The control circuit portion 100 causes a shutter motor driving circuit 400 to control the shutter motor M2 so that an edge portion of the sensor flag 39 corresponding to width size information of the sheet P used, which is inputted from the external host prevent 200 is detected by the second photo-sensor 40B. That is, the shutter motor M2 is subjected to normal rotation control (CW (clockwise)) or reverse rotation control (CCW (counterclockwise)), so that the left and right shutter mechanism 34L and 34R are driven.

Then, at the time when the edge portion of the sensor flag 39 corresponding to width size information of the sheet P which is to be used and passed through the nip N is detected by the second photo-sensor 40B, with the time as a starting point, the shutter motor M2 is driven for several msec and is stopped. As a result, outside edge portions of the outer shutter members 37(L, R) of the left and right shutter mechanisms 34(L, R) are moved to positions corresponding to the width of the sheet P which is to be used and passed through the nip N.

An operation of the left and right cooling fans 33(L1, L2, R1, R2) in the fixing device 6 in this embodiment will be described. During image formation, in the case where sheets smaller in width than a size of maximum width sheets P usable in and passable through the fixing device 6 are continuously fixed by the fixing device 6, the temperature in the non-sheet-passing region increases. The third thermistor 19*b* detects an inner surface temperature of a film portion corresponding to the non-sheet-passing region.

The control circuit portion 100 controls the shutter motor control circuit 400 (FIG. 9) when the third thermistor 19*b* detects a temperature not less than a predetermined threshold temperature. That is, the inner and outer shutter members 36(L, R) and 37(L, R) of the left and right shutter mechanisms 34(L, R) are moved by the shutter motor M2 to positions corresponding to the width of the small width sheets continuously passed through the fixing device 6. Further, the control circuit portion 100 controls a cooling fan driving circuit 500 (FIG. 9), so that an operation of the cooling fans 33(L1, L2, R1, R2) in the left and right ducts 32(L, R) is started.

As a result, the non-sheet-passing portions of the assembly 10 are cooled by the cooling air from the cooling fans, so that the non-sheet-passing region temperature rise of the fixing device 6 is suppressed.

Then, when a detection temperature of the third thermistor 19*b* is below the predetermined threshold temperature, the operation of the cooling fans 33(L1, L2, R1, R2) is stopped. A temperature range of ON-OFF control of the cooling fans depending on the detection temperature of the third thermistor 19*b* is controlled so as to be changed depending on a status of the operation of the cooling fans.

The temperature range of ON-OFF control of the cooling fans 33(L1, L2, R1, R2) in this embodiment is controlled in the following manner in the case where for example, B4-size sheets (short edge feeding; 257 mm×364 mm) are continuously passed through the fixing device 6.

That is, during sheet passing, when the detection temperature of the third thermistor 19*b* reaches 200° C. (operation start temperature), the operation of the cooling fans 33(L1, L2, R1, R2) is started. Then, the non-sheet-passing portions of the assembly 10 are cooled by the cooling air, and when the detection temperature of the third thermistor 19*b* decreases to 190° C. (operation stop temperature), the operation of the cooling fans is stopped.

A characteristic feature constitution of the air blowing cooling mechanism 30 in this embodiment described above is summarized as follows. The air blowing cooling mechanism 30 is used in the fixing device (image heating apparatus) 6 including the film (rotatable heating member) 13 for heating the toner image on the sheet (recording material) at the nip N. The air blowing cooling mechanism 30 includes the duct 32 provided with the air blowing port 31 and includes the fan 33 for blowing the air toward the air blowing port 31 through the duct 32 in order to cool the predetermined region of the film 13. Further, the air blowing cooling mechanism 30 includes the first louver portion 311, provided inside the duct 32 for rectifying the air blowing from the fan 33 toward the air blowing port 31 and includes the shutter members 36 and 37 for limiting the cooling range of the film 13.

Further, the air blowing cooling mechanism 30 includes the second louver portion disposed on the downstream side of the shutter members 36 and 37 with respect to the air blowing direction of the fan 33. In the air path from the fan 33 to the film 13, with respect to the air blowing direction of the fan 33, the fan 33, the first louver portion 311, the shutter members 36 and 37, the second louver portion, and the film 13 are disposed in a named order.

According to this mechanism constitution, it is possible to provide the air blowing cooling apparatus (air blowing cooling mechanism 30) capable of controlling the direction of the cooling air after being cooled while cooling the film 13 with reliability even when the diameter of the film 13 which is the rotatable heating member becomes small.

Further, a characteristic feature constitution of the image forming apparatus A in which the fixing device (image heating apparatus) 6 using the above-described air blowing cooling mechanism 30 is summarized as follows. The film 13 which is the rotatable heating member and the second louver portion are included in the unit mountable in and dismountable from the image forming apparatus main assembly. The duct 32, the fan 33, the first louver portion 311, the shutter members 36 and 37 of the air blowing cooling mechanism 30 are disposed in the image forming apparatus main assembly.

According to this mechanism constitution, only the unit can be exchanged while leaving the air blowing cooling mechanism 30 on the image forming apparatus main assembly side, so that downsizing and cost reduction of the image forming apparatus can be realized.

Other Embodiments (1) In the above, the embodiments of the present invention were described, but numerical values of dimensions, conditions and the like mentioned in the above-described embodiments are examples, and therefore, the present invention is not limited thereto. The numerical values can be appropriately selected within a range to which the present invention is applicable. For example, fixing devices of a roller fixing type and an IH fixing type may also be used in combination with the air blowing cooling mechanisms as in the above-described embodiments.

(2) In this embodiment, as the shutter constitution, in which two shutters are provided on each of left and right sides was described, but the shutters may also be a single shutter or a plurality of shutters.

(3) The film 13 in the fixing device 6 of the film heating type described in the above-mentioned embodiments is not limited to that having a constitution in which an inner surface thereof is supported by the heater 11 and the heat-insulating holder 12 and the film 13 is driven by the pressing roller 20. For example, the film 13 may also be of a unit type in which the film 13 is stretched and extended around a plurality of rollers and is driven by either one of these rollers.

(4) The pressing member 20 forming the nip N in cooperation with the film 13 is not limited to a roller member. For example, a pressing belt unit (which is also the fixing member) including a belt stretched and extended around a plurality of rollers may also be used.

(5) In this embodiment, feeding of the sheet P to the fixing device 6 is carried out by so-called center(-line) basis feeding with a sheet width center. That is, the sheet P is fed on the basis of a longitudinal center position of the assembly 10 in a sheet passing region. Also in the case where there is a sheet passing region based on a one-side end portion (edge) (i.e., in so-called one-side basis feeding in which feeding of the sheet is carried out on the basis of one-side end of the sheet), similarly as in the above-described embodiment, the non-sheet-passing portion temperature rise occurs.

Also in this case, by disposing the air blowing cooling mechanism 30 similarly as in the above-described embodiment, the non-sheet-passing portion temperature rise can be suppressed. However, different from the above-described embodiment, the duct 32 is needed only on one side and therefore it is sufficient that the shutter mechanism 34 is disposed only on one side.

(6) As the fixing device 6, the device for fixing the unfixed toner image formed on the sheet by heating the toner image was described as an example, but the present invention is not limited thereto. For example, a device for increasing a gloss (glossiness) of an image by heating and re-fixing a toner image temporarily fixed on the recording paper (also in this case, the device is referred to as the fixing device) may also be used. That is, for example, the fixing device 6 may also be a device for fixing the partly fixed toner image on the sheet or a device for subjecting the fixed image to a heating process. Accordingly, the fixing device 6 may also be, for example, a surface heating device (apparatus) for adjusting a gloss or a surface property of an image.

(7) The image forming apparatus described using the printer A as an example is not limited to the image forming apparatus for forming the monochromatic image but may also be an image forming apparatus for forming a color image. Further, the image forming apparatus can be carried out in various uses, such as a copying machine, a facsimile machine, and a multi-function machine having functions as these machines, by adding necessary device, equipment and casing structure.

(8) In the above description, for convenience, treatment of the recording material (sheet) P was described using terms associated with paper (sheet), such as sheet (paper) passing, sheet feeding, sheet discharge, sheet-passing-portion, non-sheet-passing-portion and the like, but the recording material is not limited to the paper. The recording material P is a sheet-shaped recording medium (media) on which the toner image is capable of being formed by the image forming apparatus. For example, regular or irregular recording media such as plain paper, thin paper, thick paper, high-quality paper, coated paper, envelope, postcard, seal, resin sheet, OHP sheet, printing sheet, formatted paper, and the like are cited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-088693 filed on May 2, 2018, which is hereby incorporated by reference herein in its entirety.

What is claimed is:

1. An image forming apparatus for forming a toner image on a recording material, said image forming apparatus comprising:

an image heating unit including a rotatable heating member configured to heat a toner image, said image heating unit including a frame covering said rotatable heating member and having an opening portion;

an air blowing unit, provided outside of said image heating unit, including a duct, a fan configured to blow air toward said, a first louver portion provided inside said duct and configured to rectify the air from said fan, and a shutter member, provided opposed to said opening portion, configured to open and close an outlet of the air from said duct; and a second louver portion provided inside said frame and between said opening portion and said rotatable heating member, and configured to rectify the air from said opening portion toward said heating member.

2. An image forming apparatus according to claim 1, wherein said second louver portion includes a louver and a wall which form an air path, and an interval between the louver and the wall is 15 mm or less.

3. An image forming apparatus according to claim 1, wherein said fan is provided in said duct.

4. An image forming apparatus according to claim 1, wherein the recording material is fed by center basis feeding, wherein said opening includes two opening portions provided symmetrically with respect to a reference line of the center basis feeding, wherein said duct includes two duct portions provided symmetrically with respect to the reference line of the center basis feeding, each duct portion opposing a corresponding one of said opening portions, and wherein on each of duct portion sides, said fan, said first louver portion, said shutter member and said second louver portion are provided.

5. An image forming apparatus according to claim 1, wherein the recording material is fed by one surface basis feeding, wherein said duct is a single duct, and wherein said fan, said first louver portion, said shutter member and said second louver portion are provided on a side of the single duct.

6. An image forming apparatus according to claim 1, wherein said image heating unit is mountable to and dismountable from a main assembly of said image forming apparatus, and wherein said air blowing unit is provided in said main assembly of said image forming apparatus.

7. An image forming apparatus according to claim 1, wherein said heating member comprises a film.

8. An image forming apparatus according to claim 7, further comprising:

a heater configured to heat said film in contact with said film; and a pressing member configured to press said heater through said film and to form a nip nipping and feeding the recording material therethrough.

9. An image forming apparatus according to claim 8, wherein said second louver portion is positioned to said heating member on a side opposite to that of the nip.

* * * * *